US005996816A

United States Patent [19]

Bernard

[11] Patent Number: 5,996,816

[45] Date of Patent: Dec. 7, 1999

[54] TOOTHBRUSH AND DENTURE HOLDING DEVICE

[76] Inventor: Carolyn A. Bernard, 35 Ebey La., Staten Island, N.Y. 10312

[21] Appl. No.: 09/036,860

[22] Filed: Mar. 9, 1998

[51] Int. Cl.[6] ..... A47B 81/02

[52] U.S. Cl. ..... 211/65

[58] Field of Search ..... 211/65, 66; 248/111; 312/206

[56] References Cited

U.S. PATENT DOCUMENTS

D. 59,647 11/1921 Frost et al. ..... 211/65
1,915,958 6/1933 Skirrow ..... 211/65
2,912,114 11/1959 Levitt ..... 211/65
3,532,222 10/1970 Madden ..... 211/65
4,008,808 2/1977 Ramsay ..... 211/65

*Primary Examiner*—Alvin Chin-Shue
*Assistant Examiner*—Sarah Purol

[57] ABSTRACT

A Toothbrush and Denture Holding Device for holding dentures and a plurality of toothbrushes in a sanitary and disposable tray is disclosed. The device includes a bracket mountable on a wall and a disposable tray member having a recessed portion forming a basin for holding the dentures and a plurality of holes formed in opposing side portions of the tray member for holding the plurality of toothbrushes, the tray member being removably attachable to the bracket.

6 Claims, 2 Drawing Sheets

TOOTHBRUSH AND DENTURE HOLDING DEVICE

BACKGROUND OF THE INVENTION

1. Field of the Invention

The present invention relates to toothbrush and denture holders and more particularly pertains to a new toothbrush and denture holding device for holding dentures and a plurality of toothbrushes in a sanitary and disposable tray.

2. Description of the Prior Art

The use of toothbrush and denture holders is known in the prior art. More specifically, toothbrush and denture holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art toothbrush and denture holders include U.S. Pat. No. 5,184,718; U.S. Pat. No. 4,951,828; U.S. Pat. No. Des. 315,954; U.S. Pat. No. Des. 314,109; U.S. Pat. No. 4,140,222 and U.S. Pat. No. Des. 273,565.

While these devices fulfill their respective, particular objectives and requirements, the aforementioned patents do not disclose a new toothbrush and denture holding device. The inventive device includes a bracket mountable on a wall and a disposable tray member having a recessed portion for holding the dentures and a means for holding the plurality of toothbrushes, the tray member being removably attachable to the bracket.

In these respects, the toothbrush and denture holding device according to the present invention substantially departs from the conventional concepts and designs of the prior art, and in so doing provides an apparatus primarily developed for the purpose of holding dentures and a plurality of toothbrushes in a sanitary and disposable tray.

SUMMARY OF THE INVENTION

In view of the foregoing disadvantages inherent in the known types of toothbrush and denture holders now present in the prior art, the present invention provides a new toothbrush and denture holding device construction wherein the same can be utilized for holding dentures and a plurality of toothbrushes in a sanitary and disposable tray.

The general purpose of the present invention, which will be described subsequently in greater detail, is to provide a new toothbrush and denture holding device apparatus and method which has many of the advantages of the toothbrush and denture holders mentioned heretofore and many novel features that result in a new toothbrush and denture holding device which is not anticipated, rendered obvious, suggested, or even implied by any of the prior art toothbrush and denture holders, either alone or in any combination thereof.

To attain this, the present invention generally comprises a bracket mountable on a wall and a disposable tray member having a recessed portion for holding the dentures and a means for holding the plurality of toothbrushes, the tray member being removably attachable to the bracket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toothbrush and denture holding device apparatus and method which has many of the advantages of the toothbrush and denture holders mentioned heretofore and many novel features that result in a new toothbrush and denture holding device which is not anticipated, rendered obvious, suggested, or even implied by any of the prior art toothbrush and denture holders, either alone or in any combination thereof.

It is another object of the present invention to provide a new toothbrush and denture holding device which may be easily and efficiently manufactured and marketed.

It is a further object of the present invention to provide a new toothbrush and denture holding device which is of a durable and reliable construction.

An even further object of the present invention is to provide a new toothbrush and denture holding device which is susceptible of a low cost of manufacture with regard to both materials and labor, and which accordingly is then susceptible of low prices of sale to the consuming public, thereby making such toothbrush and denture holding device economically available to the buying public.

Still yet another object of the present invention is to provide a new toothbrush and denture holding device which provides in the apparatuses and methods of the prior art some of the advantages thereof, while simultaneously overcoming some of the disadvantages normally associated therewith.

Still another object of the present invention is to provide a new toothbrush and denture holding device for holding dentures and a plurality of toothbrushes in a sanitary and disposable tray.

Yet another object of the present invention is to provide a new toothbrush and denture holding device which includes a bracket mountable on a wall and a disposable tray member having a recessed portion for holding the dentures and a means for holding the plurality of toothbrushes, the tray member being removably attachable to the bracket.

Still yet another object of the present invention is to provide a new toothbrush and denture holding device wherein the tray is easily removable from the bracket for disposal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
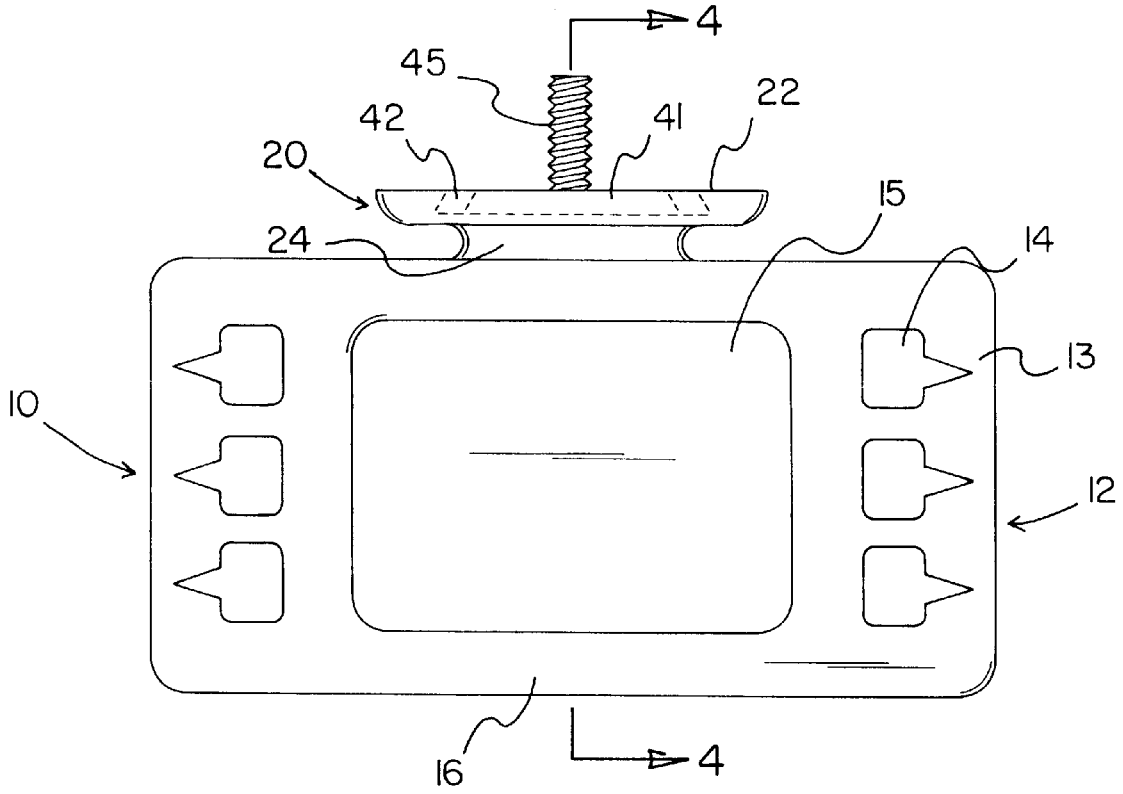
FIG. 1 is a plan view of a new toothbrush and denture holding device according to the present invention.

With reference now to the drawings, and in particular to FIGS. 1 through 5 thereof, a new toothbrush and denture holding device embodying the principles and concepts of the present invention and generally designated by the reference numeral 10 will be described.

More specifically, it will be noted that the toothbrush and denture holding device 10 comprises a bracket 20 mountable on a wall such as a bathroom wall and a tray member 12 having a recessed portion 15 forming a basin for holding the dentures and a means for holding the plurality of toothbrushes. As further described hereinbelow, the tray member 12 is removably attachable to the bracket 20.

With reference to FIG. 1 there is shown the tray member 12 including a rectangular recessed portion 15 formed therein. The recessed portion 15 forms a basin for holding the dentures of a person using the device. The recessed portion 15 is formed to hold water or a denture cleaning solution in addition to the dentures.

The tray member 12 further is shown including a pair of opposite first side portions 13 and a pair of opposite second side portions 16. The first side portions 13 are shown having a plurality of holes 14 formed therethrough for holding the toothbrushes.

Figure 2:
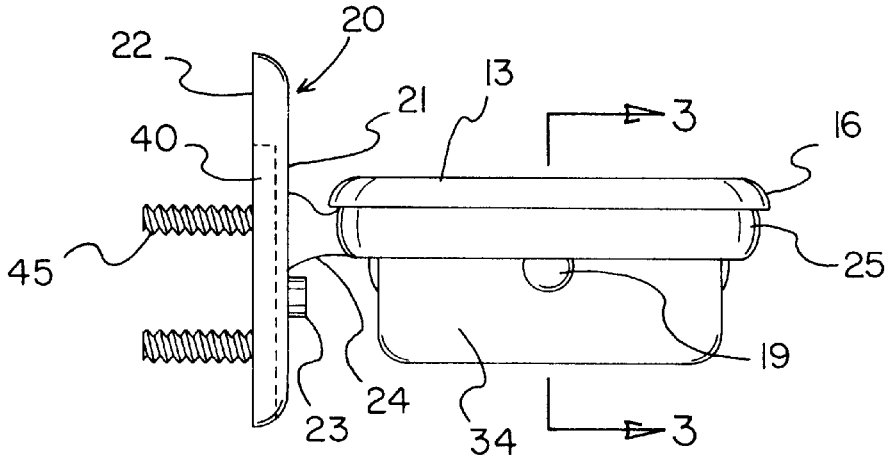
FIG. 2 is a side elevation view thereof.
Figure 3:
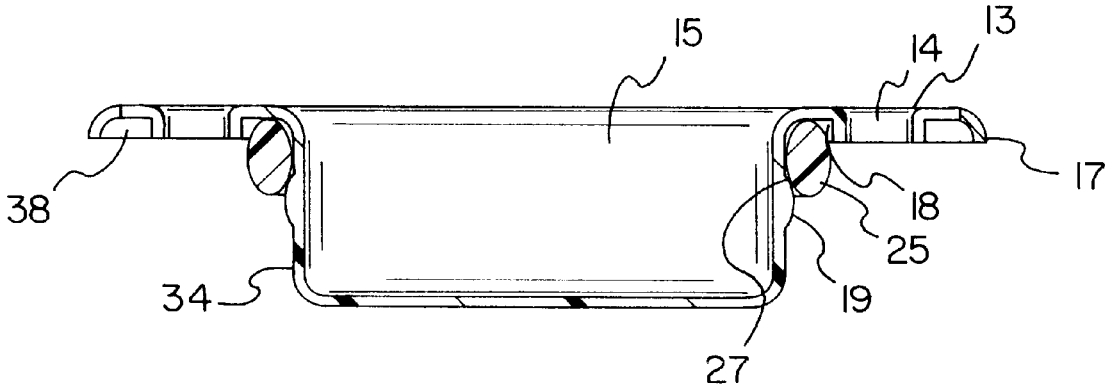
FIG. 3 is a cross sectional view taken along line 3—3 of FIG. 2.
Figure 4:
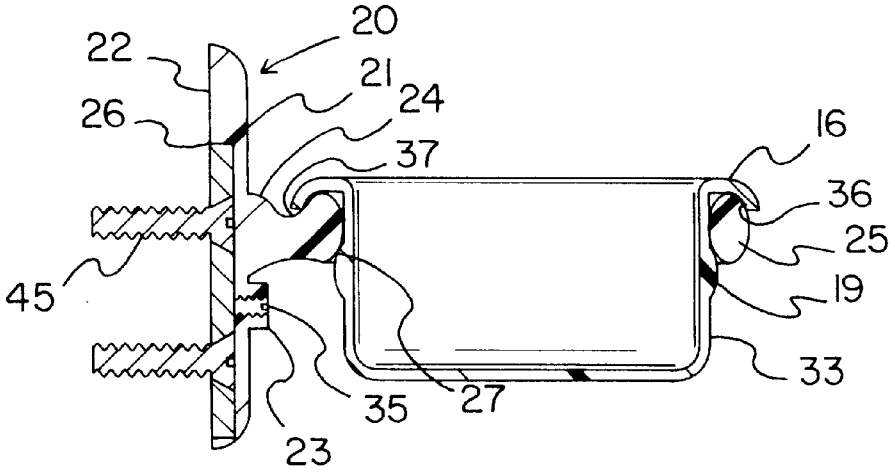
FIG. 4 is a cross sectional view taken along line 4—4 of FIG. 1.
Figure 5:
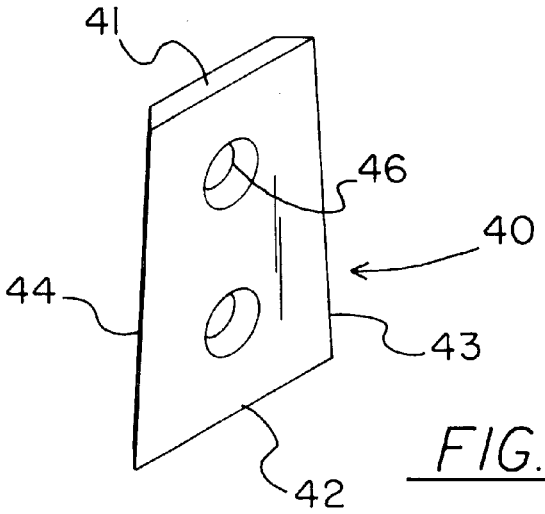
FIG. 5 is a perspective view of the beveled member of the present invention.

With reference to FIG. 2 the bracket 20 is shown including a wall mountable member 28, an integral arm member 24 shown extending perpendicularly from the wall mountable member 28, and an integral ring member 25 extending from the arm member 24. As more clearly shown in FIGS. 3 and 4, the ring member 25 is configured and dimensioned to closely receive the recessed portion 15 of the tray member 12 in such manner that the tray member 12 is removably attachable to the bracket 20.

The first and second side portions 13 and 16 respectively are shown formed in surrounding relationship to the recessed portion 15 of the tray member 12. The first side portions 13 have a lower surface 17 in which is formed a ring member receiving recess 18 adjacent a recessed portion side wall 34. The second side portions 16 have a lower surface 36 in which is formed a ring member receiving recess 37 adjacent a recessed portion side wall 33. The recessed portion side walls 33 and 34 further are shown including a plurality of integral protrusions 19 formed in spaced relationship to the ring member receiving recesses 18 and 37. The protrusions 19 are frictionally engageable to a lower inside surface 27 of the ring member 25 and hold the tray member 12 in a seated position.

The wall mountable member 28 is mountable to a wall by means of a beveled slot 26 shown formed in a back portion 22 thereof. The beveled slot 26 is configured and dimensioned to slidingly engage a beveled member 40 which is attachable to the wall. A threaded aperture 23 is shown formed on a front portion 21 of the wall mountable member 28 for threadingly receiving a set screw 35 which secures the wall mountable member 28 to the beveled member 40.

The beveled member 40 includes a pair of beveled side portions 43 and 44, a top portion 41 and a bottom portion 42. A pair of tapered apertures 46 are formed therethrough for receiving a pair of screws 45 which attached the beveled member 40 to the wall.

The bracket 20 and tray member 12 of the present invention are preferably formed of a resilient plastic material although the bracket 20 may be formed of a metal material to match other bathroom fixtures.

In use, a new tray member 12, which would preferably be individually packaged to keep the tray member 12 in a sanitary condition, would be seated in the ring member 25 by the custodial person cleaning the bathroom in a room of a motel, hotel or other place of public accommodation. The guests in the room would feel comfortable using the tray member 12 to store their toothbrushes and dentures and cleaning solutions if needed knowing that the tray member 12 was clean and sanitary. The toothbrushes could be hung through the holes 14 and the cleaning solution and dentures could be placed in the recessed portion 15.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toothbrush and denture holding device mountable on a wall for holding dentures and a plurality of toothbrushes comprising:

a bracket mountable on the wall, the bracket having a wall mountable member, an integral arm member extending from the wall mountable member and integral ring member extending from the arm member;

a tray member having a recessed portion for holding the dentures and a means for holding the plurality of toothbrushes, the tray member being removably attached to the bracket, the recessed portion being closely receivable within the ring member; and wherein the tray member further comprises a pair of opposite first side portions and a pair of opposite second side portions, the first and second side portions being formed in surrounding relationship to the recessed portion of the tray member and having a lower surface, the first and second side portions further comprising a ring member receiving recess formed in the lower surface.

2. The toothbrush and denture holding device of claim 1, wherein the recessed portion of the tray member further comprises a pair of opposing side walls, the opposing side walls having a plurality of protrusions integrally formed thereon, the protrusions being spaced from the ring member receiving recess and frictionally engageable to an inside surface of the ring member.

3. The toothbrush and denture holding device of claim 2, wherein the wall mountable member further comprises a back portion having a beveled slot, the beveled slot being slidingly engageable to a beveled member attachable to the wall.

4. The toothbrush and denture holding device of claim 3, wherein the wall mountable member further comprises a front portion having a means for securing the wall mountable member to the beveled member.

5. The toothbrush and denture holding device of claim 1, wherein the means for holding the plurality of toothbrushes further comprise a plurality of holes formed in the first side portions.

6. The toothbrush and denture holding device of claim 1, wherein the recessed portion is rectangular.

* * * * *